United States Patent [19]

Smith

[11] 4,035,132

[45] July 12, 1977

[54] GAS-FIRED RADIANT HEATER

[76] Inventor: Thomas M. Smith, P.O. Box C94, 114 Villinger Ave., Cinnaminson, N.J. 08077

[21] Appl. No.: 674,409

[22] Filed: Apr. 7, 1976

[51] Int. Cl.[2] ..... F23D 13/12

[52] U.S. Cl. ..... 431/7; 431/328

[58] Field of Search ..... 431/328, 329, 7; 126/92 AC, 92 B

[56] References Cited

U.S. PATENT DOCUMENTS

| | | | |
|---|---|---|---|
| 2,227,899 | 1/1941 | Grubb | 431/328 |
| 2,921,176 | 1/1960 | Scofield | 431/328 |
| 3,824,064 | 7/1974 | Bratko | 431/328 |
| 3,963,414 | 6/1976 | Jensen | 431/329 |

*Primary Examiner*—Carroll B. Dority, Jr.
*Attorney, Agent, or Firm*—Connolly and Hutz

[57] ABSTRACT

Radiant heater having supported porous refractory panel through which combustion mixture passes and on the surface of which mixture burns as it emerges, has a narrow stream of incombustible relatively cold gas like air pumped through the panel adjacent the support to act as a barrier seal and minimize the leakage of combustible gas around the margin of the panel, and the consequent burning of such leaking gas, which burning can damage the marginal support and cause flashback. Panel can have edges held on tubular frame sealed to a back plate to provide a simpler heater construction with combustion mixture plenum defined by back plate and frame, and with cold gas supply to the tubular passageways in frame.

11 Claims, 6 Drawing Figures

GAS-FIRED RADIANT HEATER

The present invention relates to radiant heaters such as those described in U.S. Pat. Nos. 3,785,763, 3,248,099 and 3,824,064. Such heaters are very efficient and very desirable for generating extremely large quantities of concentrated infrared energy.

Among the objects of the present invention is the provision of novel constructions and operating techniques for the foregoing heaters.

The foregoing as well as additional objects of the present invention will be more fully understood from the following description of several of its exemplifications, reference being made to the accompanying drawings in which.

According to the present invention a gas-fired radiant heater having a supported porous refractory panel through which a gaseous combustion mixture is passed and on the face of which the mixture is burned as it emerges, is operated with improved results by passing a narrow stream of relatively cold non-combustible gas through the panel immediately adjacent the panel support as the foregoing burning takes place.

This non-combustible gas stream acts as a barrier which directs the combustible mixture through the refractory panel and minimizes leakage of combustible gases past the frame members that hold the panel. By acting as a barrier to the combustible mixture, the non-combustible gas stream significantly reduces the importance of the seal shown in U.S. Pat. Nos. 3,785,763 and 3,824,064, greatly reducing burner assembly time and parts tolerance. The non-combustible gas stream also greatly reduces contact of the hot gaseous products resulting from the combustion at the panel's surface, with the frame members, keeping them much cooler and reducing heat warpage.

The narrow stream of relatively cold gas is conveniently provided by holding the porous panel on a ledge carried by the combustion mixture plenum covered by the porous panel, and a slot extends along the ledge and is connected to a supply of the non-combustible gas.

Another feature of the present invention is the construction of a gas-fired radiant heater with a back plate, a tubular frame member having lengths extending around the margin of the back plate and sealed to it to define a combustion mixture plenum between the opposing lengths of the frame member and on one face of the back plate, the frame member having means for receiving a supply of gas into its tubular interior and also having a face receiving a porous refractory panel to cover the plenum.

Figure 1:
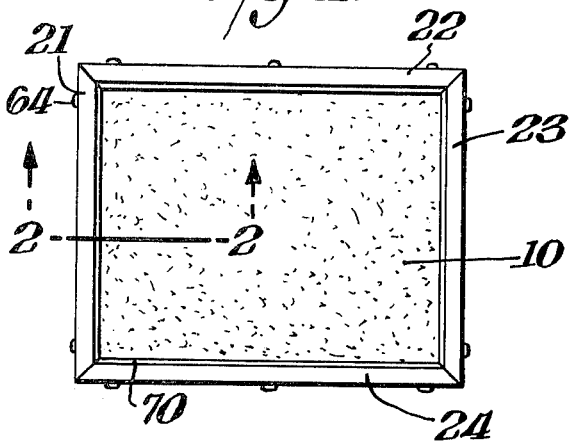
FIG. 1 is a face view of an infrared heater according to the present invention.
Figure 2:
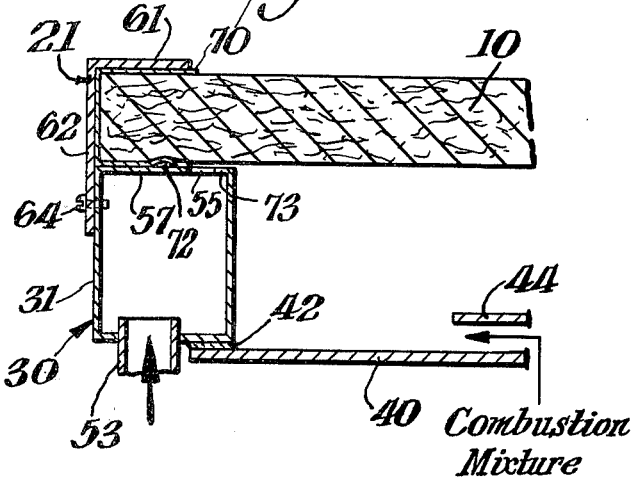
FIG. 2 is a sectional detail view of the heater of FIG. 1, taken along the line 2—2.
Figure 4:
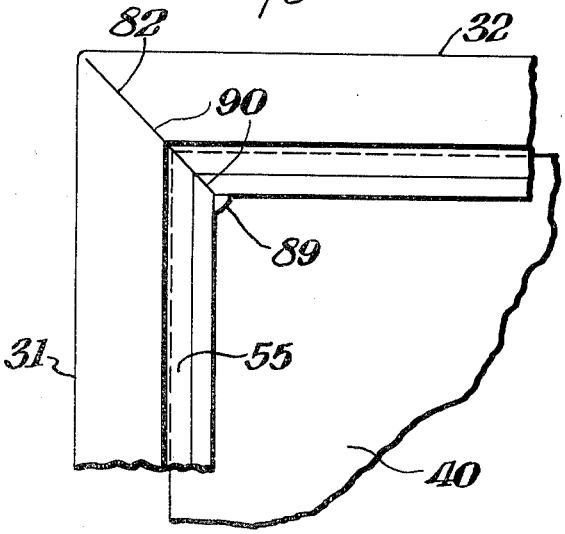
FIG. 4 is a detail view similar to that of FIG. 1, showing some structural features suitable for the infrared heaters of the present invention.

Turning now to the drawings, the radiant heater of FIGS. 1 and 2 has the usual porous refractory panel 10 held at its margins by upper frame members 21, 22, 23, 24, against a lower frame 30. Frame 30 has four lengths of tubular supports, two of which are shown in FIG. 4 at 31, 32, secured to the margins of a rectangular back plate 40 by welding, brazing, cementing as with epoxy or other cement, or otherwise joining in a gas-tight manner, indicated at 42. Back plate 40 and the four tubular supports thus define a plenum for the combustion mixture fed to the panel 10. A pipe connection can be welded through an aperture in the back plate in the standard manner for receiving a combustion mixture supply conduit, and a baffle a portion of which is shown at 44, can be fitted to help equalize the combustion mixture flow toward all portions of panel 10.

One or more lengths of the tubular support frame can also have a connector 53 welded through an aperture for the supply of air from a pump or a storage tank or the like. A slot 55 is also provided along the top wall 57 of the support frame for discharge of the air from the interior of the tubular support lengths through the margin of the porous refractory panel. The individual tubular supports are mitered together at the corners of the frame with the mitered joint sealed as by welding, brazing, cementing or otherwise securely joining, to keep combustion mixture from leaking out of the plenum as well as from being nonuniformly diluted with the air moving through the tubular supports.

The upper frame members 21, 22, 23, 24 are shown as angles each having an upper flange 61 that overlies a margin of the outer face of panel 10, and a depending flange 62 that is secured to a lower frame member, as by means of the screws 64. The screws can be threadedly received in the outer walls of the tubular support frame, and can pass through openings in the flange 62. Such openings can be elongated in the direction perpendicular to the wall 57 if adjustability is to be provided for the spacing between wall 57 and flange 61.

The porous panel 10 permits the gaseous combustion mixture to freely pass through it so that pressures in the plenum need only be about 2 to 7 inches of water above the ambient atmosphere to provide very effective uniform combustion over the entire outer face of panel 10. A similar air pressure in the interior of the tubular support will cause streams of air to pass through the margin or porous panel 10 and emerge from its outer face. The porous interfelted fibrous structure of the panel surprisingly does not permit much change in the width of the air stream moving through the panel, particularly when the pressure that propels the air stream from the tubular support is within an inch or two of water height with respect to the pressure that propels the gaseous combustion mixture from the plenum. This is readily noted when the burner is in operation inasmuch as the outer surface of the panel glows red hot over its entire area except for a narrow and sharply defined band around its periphery and adjacent the outer frame members.

The frame members are thus kept much cooler than they would be without the marginal air stream, particularly where the burners are operated with the outer surface of their panels 10 positioned in a generally vertical plane, or positioned facing downwardly. In those positions the very hot gaseous products resulting from the combustion at the panel's surface, rise and flow over the frame members of the burners of U.S. Pat. Nos. 3,785,763 and 3,824,064 to heat them up to high temperatures that can reach 1000° F in some cases. The marginal air stream of the present invention, on the other hand, acts as a barrier layer against the hot combustion products, keeping those hot gases from directly reaching the frame members in substantial volume. Marginal streams taken from the air at ambient temperatures and passing through a panel as much as 1½ inch thick will generally keep the outer faces of 1/16 inch thick steel frame members several hundred degrees F below the temperatures corresponding frame members reach in the constructions of the above patents. The temperature of the frames of the present invention will be even lower where the heater is used to heat objects that do not cause much reflection of the burner's radiating heat back to those frame members.

A further benefit of the present invention is that by minimizing contact of the hot combustion gases with the frame members and thus keeping them much cooler, emission of radiation from the frame members themselves is greatly reduced. The heaters of the present invention can be positioned much closer to their targets, than prior art heaters and still permit minimizing damage to the target in the event of emergency shutdown. The porous refractory panel itself cools down very sharply when the fuel gas flow into the plenum is stopped and the air flow is maintained, but the frame members of the prior art heaters take much longer to cool down. When using such heaters to heat a moving web of heat-sensitive material, the heaters are preferably arranged to generate much more heat than the web can tolerate should the web stop moving. With the prior art heaters the rate of cool-down for the frame members can become a critical factor that determines how close the prior art heaters can be brought to the web without damaging the web in the event the web suddenly stops and the heater cannot be mechanically pulled away from it. The heaters of the present invention don't have to be pulled away and can therefore be installed in a less expensive manner. Their closer proximity to the target makes the heat transfer to the target more efficient and enables the use of less fuel to achieve the desired results.

Moreover in some treatments such as the volatilizing of water from a target web, the most effective radiation wave-lengths are between about 3.2 and about 3.6 microns, a range that is most efficiently produced at relatively low radiation temperatures. By moving the heaters of the present invention closer to their targets, their radiation temperatures can be diminished to thus make more efficient use of the fuel energy and with less fuel, without decreasing the treatment effectiveness.

Heaters placed very close to targets may be desirably made to extend beyond the edges of the target to attain greater treatment uniformity. Each such extension can be approximately equal to the distance from the heater to the target, for good results.

Locating slot 55 immediately opposite the panel margins alongside the inner edges of the upper frame members 21, 22, 23, 24 helps guide the protective streams to the desired location. This guiding action is further improved by sealing the edges of the panel so that not much non-combustible gas can escape laterally. FIG. 2 illustrates a prior art edge sealing technique according to which a thin foil of aluminum 70, about 2 mils thick, is wrapped around each panel edge, and the lower face of the foil is sealed against wall 57 by a narrow line of sealant 72 such as a silicone rubber vulcanized in place.

According to the present invention, when edge sealing of the panel is desired, the sealant 72 can be of a material such as ordinary rubber or neoprene, that need not be resistant to high temperatures. However during normal operation of the burner construction of the present invention, only air from the interior of the tubular support will tend to leak out from the margins of the panel. Such leakage is not dangerous nor is it extensive when sealant 72 is entirely omitted. Omitting the foil 70 can cause extensive air leakage unless the outer frame is a very close fit against the support frame. The marginal air stream with or without leakage keeps the combustion mixture from leaking out the edges of the panel.

The slot 55 does a very effective job when it is about ¼ inch wide, although it can be as little as 1/16 inch or as much as ½ inch wide and still give good results. The width of protective gas stream emerging from the face of the porous panel is generally a little larger than the width of the slot, and changes in gas pressure vary this broadening effect. A desirable gas pressure in the tubular frame is one that approximately equals the pressure in the combustion mixture plenum.

The cooling and combustion-mixture-leak-blocking effects of the marginal stream of the present invention are also obtained when the discharge slot 55 is located further toward the outer face of the frames so that the gas discharged through the slot is directed partly or completely at frame flange 61. Most of the discharged gas will then move along the interior of panel 10 and escape just past the inner margin of that frame flange.

It is not essential to make the tubular support members gas-tight where they are threadedly engaged by screws 64. Even where relatively expensive inert gas is used rather than air, the leakage through such threaded connections is miniscule as compared with the discharge through slot 55. The threaded engagement can be sealed however, as by applying pipe-thread dope or the like to the mating threads before they are engaged. Alternatively the connection between the outer and inner frames can be made as shown in U.S. Pat. Nos. 3,785,763 and 3,824,064.

Figure 3:
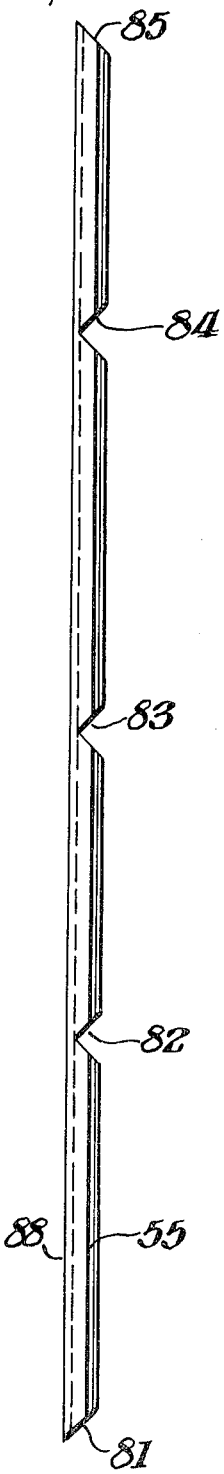
FIG. 3 is a plan view of a component that can be used in the making of the heater of FIGS. 1 and 2.

Instead of making tubular frame 30 of four separate lengths, it can be made from a single piece of formed sheet metal, as illustrated in FIG. 3. An elongated strip of sheet metal twenty to fifty thousandths of an inch thick can be bent into the form illustrated by the sectional view in FIG. 2, or a standard metal tube of rectangular section can be milled to cut the slot 55 through one wall, and the resulting shape then subjected to mitering cuts 81, 82, 83, 84 and 85 as shown in FIG. 3. These cuts leave wall 88 intact, and the mitered length is then bent to form a one-piece tubular frame a corner of which is shown in FIG. 4. The inner edge of each corner is then welded, brazed, cemented or otherwise joined as at 89 to seal the entire height of that corner, and the tubular frame is ready for similar joining to the back plate 40.

It is not necessary to seal the outer face 90 of the mitered joints, particularly if the joints are a close fit. A little extra leakage at those locations from the interior of the tubular frame does no particular harm. However, that outer face can be sealed, especially if lateral leakage from the frame margin takes place.

The tubular frame need not extend inwardly of the slot 55, although it helps to have that frame provide an additional flat support 73 for the porous panel 10. Such support can be reduced to the thickness of the metal from which the tubular frame is made, as by suitably shaping the tube from which it is sliced, or by milling the slot 55 alongside the inner wall of the tubular frame.

Figure 5:
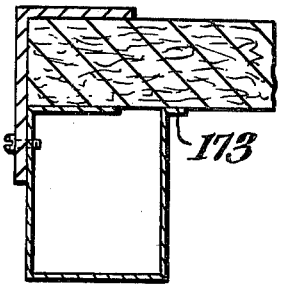
FIG. 5 is a view similar to that of FIG. 2 showing an optional method of constructing the heaters of the present invention.

FIG. 5 shows another tubular frame construction of the present invention which is simple to manufacture. Here a flat support 173 takes the place of support 73 and extends toward the center of the plenum.

It is also helpful to seal the outer margin of panel 10 as by dipping it in or brushing on a hardenable liquid resin that hardens to a temperature-resistant solid. Solutions of silicone rubber, colloidal silica, and sodium silicate are examples of suitable hardenable materials. When this type of edge sealing is used, the aluminum foil is not needed.

In some installations the panel temperature is so hot and there is so much reflection of heat from the surfaces being heated by the heater, that aluminum can be damaged. Other metals such as stainless steel can then be used for the sealing foil.

Figure 6:
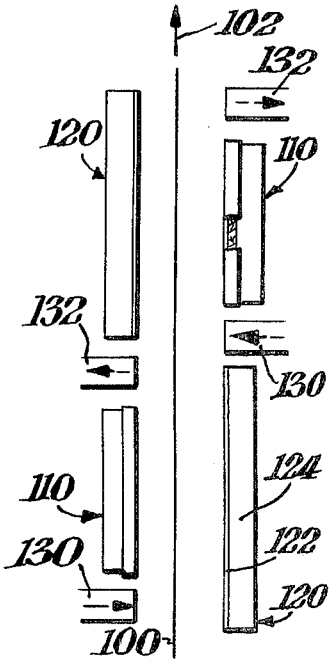
FIG. 6 is a vertical sectional view partly diagrammatic of a heating arrangement pursuant to the present invention.

FIG. 6 shows a particularly effective heating arrangement for heat treatment of a moving web 100, such as textile drying and curing or paper processing, the direction of movement being shown by arrow 102. In this arrangement a series of burners 110 face the moving web adjacent each other on opposite sides of the web. Immediately facing each burner 110 is a re-radiator 120 having a very thin layer of heat-absorbing material such as oxidized stainless steel 122, backed by a high temperature insulator 124 such as refractory felt. The re-radiators are preferably substantially wider than the burners and in use the heat absorbing layer 122 absorbs substantial quantities of heat which penetrate through web 100 so that the layer becomes quite hot and re-radiates heat back to the web 100. To improve the drying or gas-removing effect of the heat treatment process, intake and exhaust ducts 130 and 132, respectively introduce streams of poorly saturated air adjacent the location where the web approaches the burner, and withdraw more saturated air adjacent the locations where the web leaves the burner. To further improve the efficiency of this system, heat from the withdrawn air can be used to preheat the incoming poorly saturated air.

The features of the present invention are not confirmed to use with panels 10 that are flat. Such panels can also be convex or concave such as when the infrared radiation they produce is to be specially oriented. Thus a concave panel does a very good job of concentrating such rays. The panels are generally formed by felting the ceramic fibers on a screen surface, and that surface can be shaped to fit the desired panel configuration. A binder of some sort, such as starch or sodium silicate or the like can be mixed in small amounts with the fibers to set and help hold the fibers to each other where they touch each other.

Obviously many modifications and variations of the present invention are possible in the light of the above teachings. It is therefore to be understood that within the scope of the appended claims the invention may be practiced otherwise than as specifically described.

What is claimed:

1. In the operation of a gas-fired radiant heater having a supported porous refractory panel through which a gaseous combustion mixture is passed and burned on the face of the panel from which the mixture emerges, the improvement according to which a narrow stream of relatively cold non-combustible gas is also passed through the panel immediately adjacent the panel support, as the combustion mixture is passed through and burned, to help cool the support.

2. The combination of claim 1 in which the panel support is at the edge of the panel and includes an edge seal for the panel, which seal closes off the edge face of the panel against leakage of gas therefrom.

3. In a gas-fired radiant heater having a porous refractory panel on the surface of which a gaseous combustion mixture is burned, which panel is held by a marginal frame over a combustion mixture supply plenum and the frame has a wall engaging the margin of the inner face of the panel, the improvement according to which the wall has a gas discharge slot extending along the frame, and gas supply means is connected to supply a stream of non-combustible gas through that slot to cause the non-combustible gas to pass through the margin of the panel and help cool the frame.

4. The combination of claim 3 in which the porous refractory panel is a panel of felted refractory fibers.

5. A gas-fired radiant heater structure having a back plate, a tubular frame member having lengths extending around the margin of the back plate and sealed to it to define a combustion mixture plenum between the opposing lengths of the frame member and on one face of the back plate, the frame member having means for receiving a supply of gas into its tubular interior and also having a face receiving a porous refractory panel to cover the plenum.

6. The combination of claim 5 in which the tubular frame member has a rectangular cross section.

7. The combination of claim 5 and further including additional framing structure for holding the outer face of the panel to the frame member, and both the frame member as well as the additional framing structure have securing means for holding them together.

8. The combination of claim 5 in which the face of the plenum is rectangular, the lengths of the frame member are mitered together at the corners of the rectangle, and the plenum is sealed at those corners.

9. The combination of claim 8 in which the mitered frame member corners are not sealed at their panel-engaging face.

10. The combination of claim 5 in which a slit extends through and along the panel-engaging face of the frame member to provide a discharge path for gas introduced into its tubular interior.

11. A gas-fired radiant heater structure having a container that holds the margin of a porous refractory panel and defines a gaseous combustion mixture plenum adjacent one face of the panel, the container having a ledge against which the inner face of the margin of the refractory panel is secured, and a slot extends along the ledge and communicates with means for supplying an incombustible gas to cause the incombustible gas to flow through the panel at its margin.

* * * * *